US011230357B2

(12) United States Patent
De Bruijn

(10) Patent No.: US 11,230,357 B2
(45) Date of Patent: Jan. 25, 2022

(54) MARINE FENDER

(71) Applicant: FENDER INNOVATIONS HOLDING B.V., Wieringerwerf (NL)

(72) Inventor: Jacob De Bruijn, Maassluis (NL)

(73) Assignee: FENDER INNOVATIONS HOLDING B.V., Wieringerwerf (NL)

( * ) Notice: Subject to any disclaimer, the term of this patent is extended or adjusted under 35 U.S.C. 154(b) by 1 day.

(21) Appl. No.: 16/485,058

(22) PCT Filed: Feb. 9, 2018

(86) PCT No.: PCT/NL2018/050092
§ 371 (c)(1),
(2) Date: Aug. 9, 2019

(87) PCT Pub. No.: WO2018/147738
PCT Pub. Date: Aug. 16, 2018

(65) Prior Publication Data

US 2019/0367139 A1 Dec. 5, 2019

(30) Foreign Application Priority Data

Feb. 9, 2017 (NL) ..... 2018349

(51) Int. Cl.
*B63B 59/02* (2006.01)
*E02B 3/26* (2006.01)
*E02B 17/00* (2006.01)

(52) U.S. Cl.
CPC ..... *B63B 59/02* (2013.01); *E02B 3/26* (2013.01); *E02B 17/003* (2013.01); *B63B 2231/50* (2013.01)

(58) Field of Classification Search
CPC ..... B63B 59/02; B63B 2231/50; E02B 3/20; E02B 3/24; E02B 3/26; E02B 3/28; E02B 17/003
See application file for complete search history.

(56) References Cited

U.S. PATENT DOCUMENTS 108,043 A * 10/1870 O'Brien ..... A47C 27/081 5/707
2,606,755 A 8/1952 Samuels
2,885,989 A 5/1959 Williamson
2,956,530 A * 10/1960 Hobbs ..... E02B 3/26 114/219
3,301,927 A 1/1967 Exley et al.
3,353,981 A * 11/1967 Jacob ..... B29C 70/66 442/136

(Continued)

FOREIGN PATENT DOCUMENTS

EP 1695902 A2 8/2006
GB 911869 11/1962

(Continued)

*Primary Examiner* — Ajay Vasudeva
(74) *Attorney, Agent, or Firm* — Hoffmann and Baron, LLP

(57) ABSTRACT

Marine fender for impact protection comprising a core of closed cell foam, wherein said core comprises at least one chamber substantially entirely surrounded by said closed cell foam and enclosing an elastically deformable closed object. The marine fender can comprise an intermediate layer that at least partly encloses the core and/or a coating that at least partly covers the intermediate layer.

13 Claims, 4 Drawing Sheets

(56) References Cited

Figure 1:
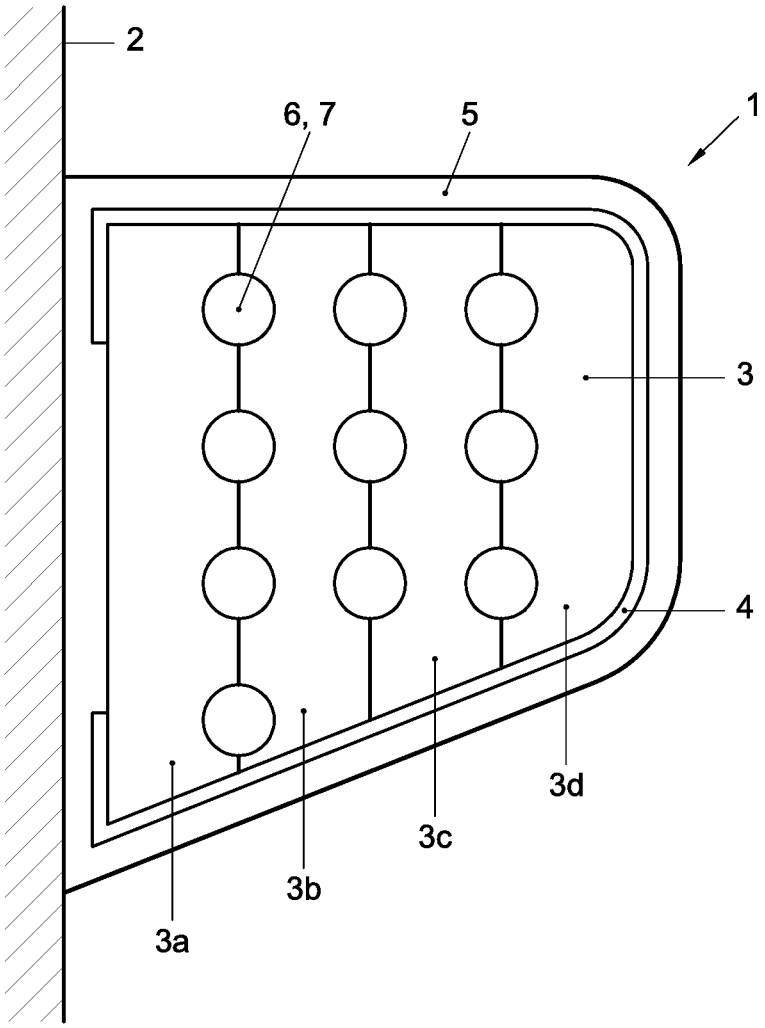

U.S. PATENT DOCUMENTS 3,522,940 A * 8/1970 Nijhuis ..... F16F 13/00 267/34
3,622,437 A * 11/1971 Hobaica ..... B63B 3/13 428/34.5
3,729,756 A * 5/1973 Cook ..... E21B 17/012 441/133
3,841,958 A 10/1974 Delorme
3,863,591 A 2/1975 Wild
3,873,654 A 3/1975 Smith
4,040,165 A * 8/1977 Miessler ..... B29C 70/025 29/458
4,129,911 A 12/1978 McDonald et al.
4,287,624 A 9/1981 Lowther
4,335,182 A 6/1982 Brand et al.
4,698,252 A 10/1987 Koch et al.
4,893,576 A 1/1990 Day et al.
5,085,487 A 2/1992 Weingartner et al.
5,247,897 A 9/1993 Pepp
5,560,312 A 10/1996 McPherson
5,878,685 A 3/1999 Hemphill et al.
7,025,644 B2 4/2006 Geier et al.
7,895,963 B2 3/2011 Roy
2002/0152943 A1 10/2002 Thomas et al.
2003/0019415 A1 1/2003 Leemon
2003/0200910 A1 10/2003 Corlett
2005/0260901 A1 11/2005 Brauers et al.
2005/0276667 A1* 12/2005 Hsu ..... F16F 13/00 405/212
2009/0056614 A1 3/2009 Roy
2013/0036960 A1 2/2013 Berman et al.
2015/0114274 A1* 4/2015 de Bruijn ..... E02B 3/26 114/219

FOREIGN PATENT DOCUMENTS

WO 2011095683 A1 8/2011
WO 2013169113 A1 11/2013

* cited by examiner

MARINE FENDER

This application claims priority from International Application No. PCT/NL2018/050092, filed on Feb. 9, 2018, which claims priority from The Netherlands patent application numbers 2018349, filed on Feb. 9, 2017, both of which are incorporated herein in their entirety.

The invention relates to a marine fender for protecting an object against impact, in particular against impact from naval activity.

Marine fenders are known and used for marine applications to prevent objects like vessels, such as ships, barges and the like, from getting damaged due to impact or contact while mooring to wharfs, docks or shores or ship-to-ship interaction. Marine fenders may also be used to protect stationary marine objects, such as bridge piers and/or pile caps, quays, docks or mooring landings from getting damaged due to contact or impact with movable marine objects, such as vessels and the like.

Fenders can have different forms or shapes, and may be fixedly attached to a fixed and/or floating marine structure. Fenders can also be suspended along the fixed and/or floating marine structures with for example cables.

The main task of a fender, however, is to protect two marine structures from severe damage due to impact when contacting each other by placing such a fender in between the two marine structures. Known fenders are made of rubber, either solid or with an air chamber in the center. The size of the fender may depend on the size, weight, use and/or operations of the vessel. Heavy ships or vessel will be difficult to stop once in movement due to a great momentum force. Therefore the fender needs to be able to absorb the momentum forces and slow down the ship without severely damaging the hull, for example by the hull getting in direct contact to the quay or wharf. Due to high forces, especially friction, between the fender and wall of the wharf or dock or between the fender and the hull of the ship, the rubber material of the fender may roll up and will wear rapidly, such that costly replacements and/or repairs are necessary at regular intervals.

Some known fenders are fixed to the hull of a ship at certain locations. This is especially important for vessels such as pilot boats which may be in direct contact with other ships, such that time consuming placement of loose suspending fenders are not an option. The mooring between the pilot boat and ship to be piloted is usually performed while both are moving, such that friction between the fender of the pilot boat and the hull of the ship to be piloted may be high, resulting in fast wear, ripping, tearing or rolling up of the rubber existing fender. Maintenance intervals may have to be regularly scheduled, during which possibly time-consuming maintenance intervals the pilot boats cannot be used, thus further increasing maintenance costs.

Moreover, known fenders, especially the type mounted to hulls of ships, are fixed by means of plates, clamping and holding the rubber fender in place. The plates are mounted to the hull with heavy bolts. Heavy bolts are needed due to the high forces acting on the fender during use. The bolts are mounted in holes that are drilled through or in the structure like the hull of the ship, enhancing possible leakage in, for example, rough sea with high waves and/or bad weather. Replacement of such fenders is time consuming and may result therefore in high maintenance cost, as mostly the fender needs to be disassembled for repair or replacement, which often has to be done in a dock or other special repair environment.

Existing rubber fenders are heavy, negatively effecting fuel efficiency and lowering maximum speed possible for, in particular, such fast ships like pilot boats or other fast marine vessels. The weight comes especially from the solid rubber and the mounting with heavy materials, like the above mentioned bolts and plates.

Especially when using known fenders in, for example, a lock of a harbour, replacing or repairing damaged fenders can be costly. Not only maintenance costs are relatively high, but also valuable time during repair in which the lock can not be used.

Another known type of fender comprises a core of at least a closed cell foam part, an intermediate layer fully enclosing the core comprising at least a fiber reinforced cloth and a coating that at least partly covers the intermediate layer. This type of fender is relatively light weight and strong and has a good performance and resistance against impact. However, for large and/or heavy and/or fast vessels and, consequently, relatively large possible impact loads such a fender becomes rather bulky and/or rather heavy. Also, such a high-resistance fender may become relatively complex to manufacture and, thus, rather expensive.

An object for the invention is to provide a marine fender that obviates at least one of the above mentioned drawbacks while maintaining the advantages. Preferably, a relatively lightweight and/or compact high-resistance fender is provided.

Thereto, the invention provides a marine fender for impact protection comprising a core of closed cell foam, wherein said core comprises at least one chamber substantially entirely surrounded by said closed cell foam and enclosing an elastically deformable closed object.

In this way, a relatively light-weight, still relatively strong, fender can be provided of which the elasticity is high enough to also absorb heavy impact loads without damaging the fender. By providing such an elastically deformable closed object, the spring characteristics of the fender highly improve with respect to the known coil springs used. In fact, upon high impact loads, it is observed that the coil springs break, while the elastically deformable closed object returns back to its original shape after such a high impact, as well as the foam surrounding it. This significantly improves the protection of the vessel, reduces repair costs, and improves safety of the vessel and its load. Moreover, the features of the closed cell foam, as well as the chamber being substantially entirely surrounded by said closed cell foam, as well as the elastically deformable object being a closed object, all lead to a fender that is relatively well protected against water absorption in case of damage. Also, the fender according to the invention can have a smaller size for the same or similar energy absorbing capacity as compared to a prior art fender. This allows a more compact and/or more slender-shaped fender.

Preferably, the elastically deformable closed object may tightly fit in said at least one chamber, which can further enhance the resiliency of the fender, when there is no air pocket in between the closed cell foam and the elastically deformable closed object. Load can be transferred directly from the closed cell foam to the elastically deformable closed object, thereby improving the overall elastic characteristics of the fender. For example, the external dimensions of the elastically deformable closed object may be the same as the internal dimensions of the corresponding chamber as to obtain a tight fit. Alternatively or additionally, the elastically deformable closed object may clampingly fit in the chamber. For example, the external dimensions of the elastically deformable closed object may be slightly larger than the internal dimensions of the corresponding chamber as to obtain a clamping fit. Further, the elastically deformable closed object may be inserted in the chamber and the connection to the chamber may be provided by the tight fitting or clamping fitting. Alternatively and/or additionally, the elastically deformable closed object may be connected to the chamber by means of an adhesive such as a glue.

More preferably, said core can comprise a plurality of said chambers, each chamber comprising an elastically deformable closed object. The more chambers enclosing an elastically deformable closed object, the higher the resiliency of the fender, further improving load absorption of heavy shocks. The plurality of chambers can be equally distributed over the fender, or can be concentrated on places where more heavy shocks may be expected. The size of the chambers and/or of the enclosed elastically deformable closed object can be equal over the fender or vary as well according to where heavy load is to be expected. The size and/or distribution of the chambers and/or of the enclosed elastically deformable closed object can be optimized depending on the use of the vessel and/or where heavy impact is most likely.

Advantageously, the core comprises at least two blocks of closed cell foam, wherein said at least one chamber extends into two adjacent blocks of closed cell foam. Closed cell foam is typically provided in solid premanufactured blocks of more or less regular dimensions. From such solid premanufactured blocks, a predetermined form can be cut or sawn out or milled or otherwise extracted by abrasive means, to produce a desired core form, such that every desired form of the fender can be obtained, which gives the designer a large design freedom, but also allows obtaining a form suitable for optimal protection of the object. Preferably, the at least one closed cell foam part of the core is manufactured from such a solid premanufactured foam block. To obtain the desired thickness of the fender, such blocks can be piled up, preferably with the longest and largest sides facing each other. By providing said at least one chamber "between" two adjacent blocks, i.e. extending into said adjacent blocks of closed cell foam, the manufacturing process of said chambers, as well as insertion of the elastically deformable closed object can be simplified.

It may be preferred that said at least two blocks of closed cell foam have a mutually different density. By providing blocks of closed cell foam with mutually different densities, the elasticity of the fender's core can be made variable over a fender's length and/or thickness. The elasticity can for example be linearly variable or variable in a progressive way, for example in a fender's core with inwardly increasing density. The density can also be varied over the fender's length according to where heavier impacts may be expected.

Advantageously, said elastically deformable closed object can be a substantially spherical object. Aa a spherical object does not have any edges or corners, a spherical object has relatively better spring characteristics. However, any other closed form, such as a cylindrical or pyramidal shape, is also possible. In this context, a closed object is to be understood as a three-dimensional object, preferably a convex object, which fully encloses a volume, which volume can be solid or not. A coil spring or spiral spring is not considered a closed object, as it does not fully enclose a volume.

Said elastically deformable closed object can preferably comprise rubber, as rubber is known for its elastic properties. At the same time, rubber can be rather insensitive to damage, even under relatively heavy load. Said elastically deformable closed object can for example substantially entirely be made of a plastic material, such as for example polymer or polyurethane, alternatively rubber may be used. The elastically deformable closed object can also comprise only a shell, e.g. made from polymer or polyurethane. Alternatively, the elastically deformable closed object may comprise closed cell foam having a density that is different from the surrounding closed cell foam density. In all of these cases, the choice of material for the elastically deformable closed object may be determined by the desired elastic properties of the material.

It is preferred that said elastically deformable closed object is a hollow object. The hollow object can typically be filled with air, which air can have the same pressure as the surrounding pressure, or which air can be pressurized, such that the air inside the hollow closed object has a higher pressure than the surrounding air. A hollow object typically filled with air can produce a good bouncing effect when exposed to an impact. Instead of air, the hollow closed object may be filled with another gas such as nitrogen or similar. Such a bouncing effect is advantageous for returning to its original size after an impact. As such, the elastic properties for resisting to an impact of the fender greatly improve when using elastically deformable hollow closed pockets.

Advantageously, said elastically deformable closed object can be a ball-like or ball-shaped object comprising a substantially spherical closed shell, for example a shell made of a material comprising rubber and/or polymer and/or polyurethane, or of any other material with similar elastic properties or a combination thereof, or for example of leather. The shell can be filled with air, which air can be pressurized or pressureless, as for example in balls used in sports, e.g. tennis ball. Such a tennis ball may e.g. be used with or without skin. Of course, any other ball may be used instead. Alternatively, the substantially spherical closed shell can also be filled with another elastically deformable material. Preferably, the material of the shell has sufficient elastic characteristics from its own, such that it provides for the "bouncing"-effect of the closed pocket.

More preferably, said elastically deformable closed object can be a pressureless ball. In this context, pressureless is to be understood as not being pressurized, such that air pressure within the ball is the same as outside the ball. The advantage of a pressureless ball is that the ball can be relatively long-lasting, as the air does not risk to escape out of the ball. At the same time, a pressureless ball has relatively good spring characteristics and/or is relatively insensitive for fatigue and/or wear and/or ageing. Also, by providing a pressureless elastically deformable object, heat dissipation due to elastic deformation can be relatively limited, which is advantageous during use, in particular for the surrounding material.

Further, the invention provides for a method for manufacturing such a marine fender. The method comprises providing at least one block of closed cell foam, providing in the at least one block of closed cell foam at least one hollow chamber entirely surrounded by said closed cell foam, inserting an elastically deformable closed object into the chamber. The method can provide a marine fender presenting one or more of the above-mentioned advantages.

The hollow chamber can preferably be carved out of the at least one block of closed cell foam, which is a relatively easy, cheap and flexible method to obtain said chamber. Contrary to common fenders, for which liquid foam is poured in a mandrel, starting from a premanufactured block of foam and carving out the required chambers, provides for an enormous flexibility, customization and/or optimization. In fact, every fender can thus be made different, depending on the required characteristics, such as the vessel's hull, the expected impact and loads etc.

In an advantageous way, the method can comprise the steps of providing at least two blocks of closed cell foam, further providing a first chamber part of the at least one chamber in a first block and a second chamber part of said at least one chamber in a second block, inserting the elastically deformable closed object in one of the first or second chamber part of the first, respectively second, block, and closing the chamber by placing the other of the first or second chamber part in the first or second block over the closed object. As closed cell foam is typically provided in solid premanufactured blocks, which blocks can be piled up to obtain a desired thickness of a fender, it is easier to first provide a first block of closed cell foam with at least one, or preferably a plurality of, first chamber parts, for example by carving them out on one of the sides of the first block, then provide a second block with corresponding second chamber parts, such that, when the two blocks are piled up, the chamber extends into the two adjacent blocks. Creating, for example by carving out, the chamber is easier on a block's surface than in a block's inside, albeit possible as well. Also the insertion of the elastically deformable closed object can be done more easily and more quickly when a first chamber part is located on a block's surface, than when the object needs to be inserted into the inside of a block of closed cell foam.

Figure 2A:
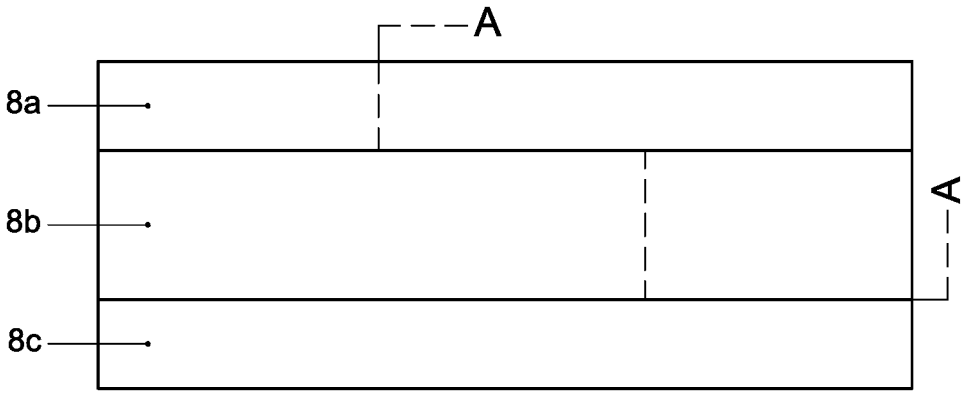
Figure 2B:
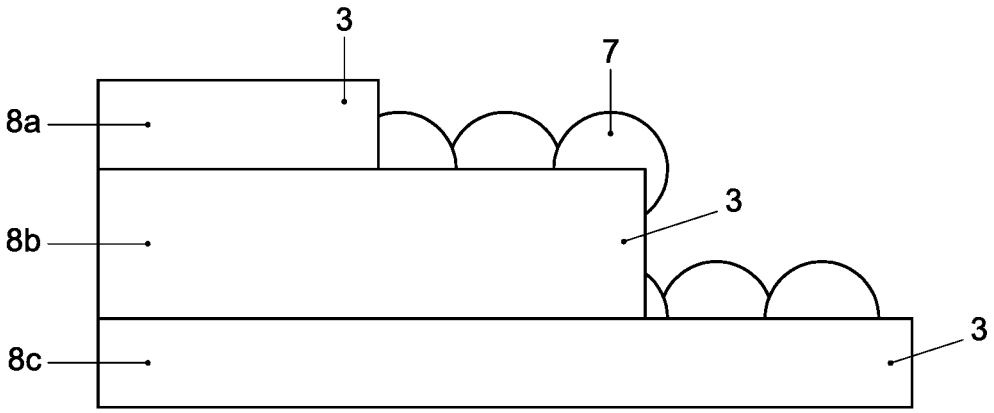
Figure 2C:
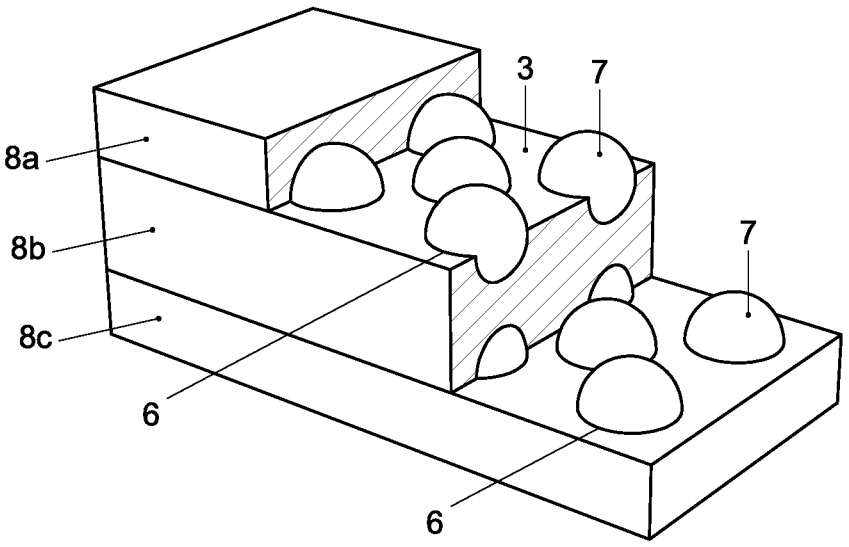

The present invention will be further elucidated with reference to a drawing comprising figures. In the drawing shows FIG. 1 a schematic cross-section of a preferred embodiment of a marine fender according to a first aspect of the invention;

FIG. 2*a* a schematic side view of blocks of closed cell foam usable for manufacturing a fender according to a first aspect of the invention;

FIG. 2*b* a schematic side view of the opened-up blocks of closed cell foam of FIG. 2*a* along the line A-A;

FIG. 2*c* a schematic perspective view on the blocks of closed cell foam of FIG. 2*b;*

Figure 3A:
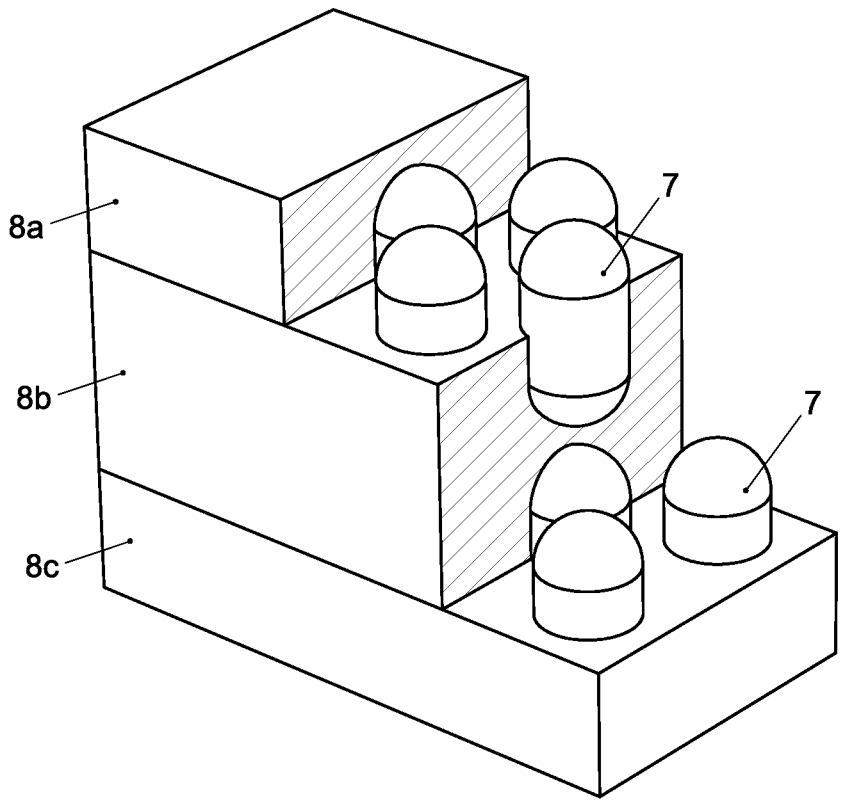
Figure 3B:
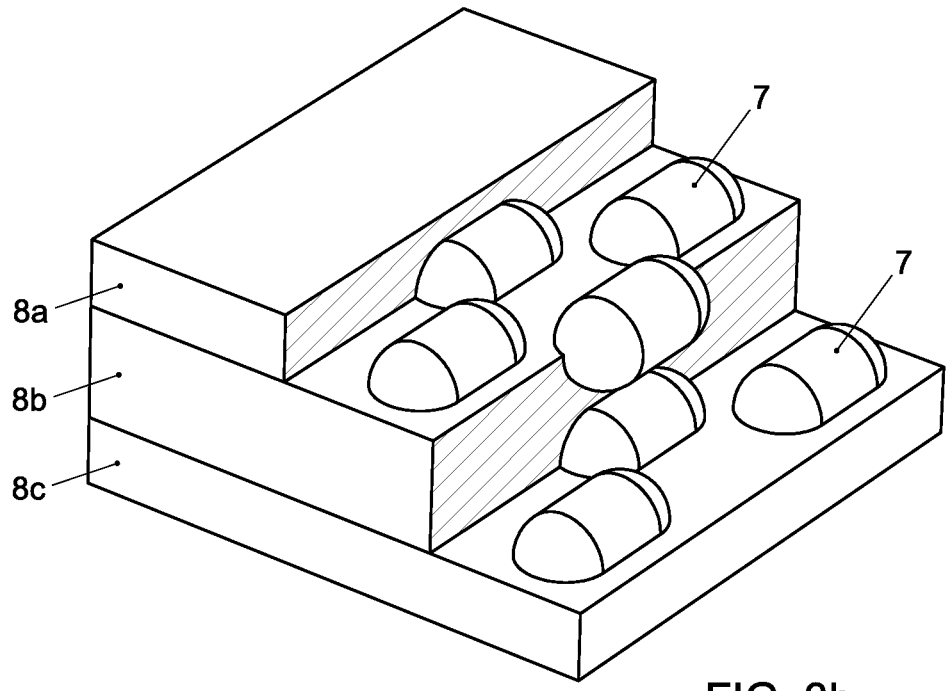
Figure 4:
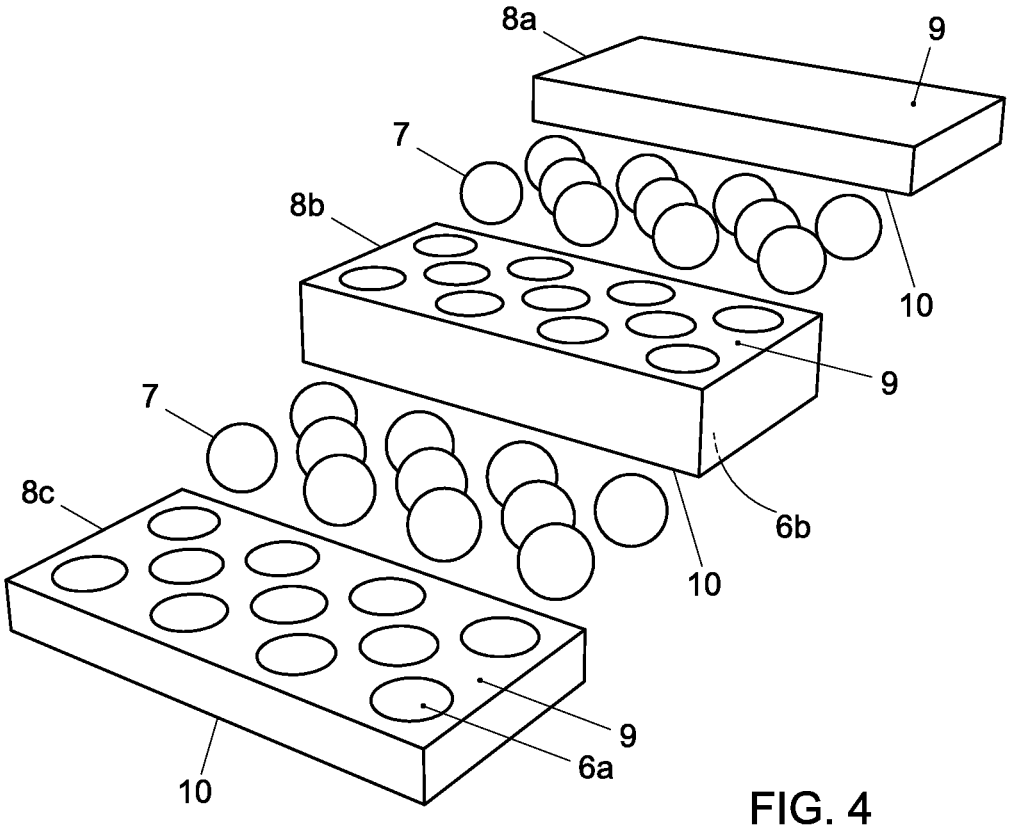
Figure 5:
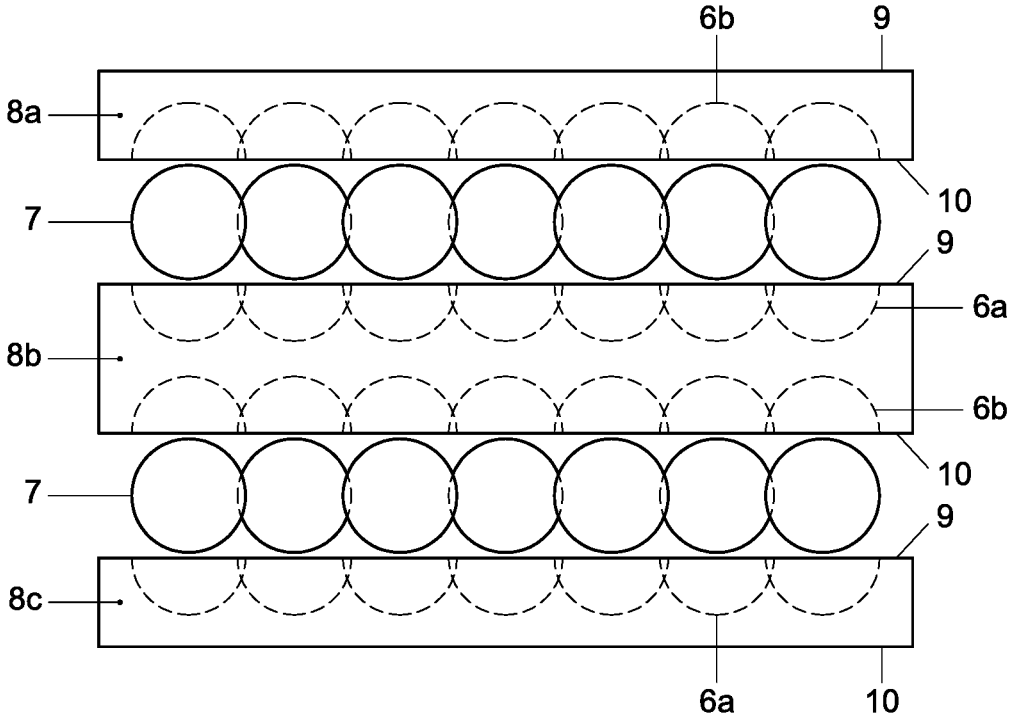

FIGS. 3*a* and 3*b* schematic perspective views on two alternative opened-up blocks of closed cell foam;

FIG. 4 a schematic perspective view on a preferred step of a method for manufacturing a marine fender according to a second aspect of the invention;

FIG. 5 a schematic side view on a preferred step of a method for manufacturing a marine fender according to a second aspect of the invention.

It is understood that the figures are given by way of exemplary embodiments only. Corresponding elements are designated with corresponding reference signs.

FIG. 1 shows a schematic cross-section of a preferred embodiment of a marine fender 1 according to a first aspect of the invention. The marine fender can be attached to a marine structure 2, for example a vessel or a mooring platform, to protect that structure against impact, for example due to unwanted collisions between vessels and/or marine structures. Marine fenders are particularly useful for vessels which often moor close to other ships and risk coming into contact with them, such as tender, patrol or pilot vessels. The fender 1 can be attached to the marine structure 2 by known attachment means such as screws, bolts, adhesives, such as for example Sikaflex®, or other attachment means known to the person skilled in the art. Advantageously, adhesives can be used such that the fender can become an inextricable part of the structure, e.g. of a vessel hull. By providing the fender as an inextricable part of e.g. the vessel hull, the marine fender can be taken into account in the vessel's design, and/or the buoyancy of the marine fender can be taken into account for stability calculations of the vessel. The marine fender 1 comprises a core of closed cell foam 3, an intermediate layer 4 at least partly enclosing the core 3 and a coating 5 at least partly covering the intermediate layer 4.

In this preferred embodiment, the intermediate layer 4 encloses the core on three sides, in particular three sides which are most exposed to possible impacts, i.e. the surfaces of the fender 1 which will be external once the fender is mounted to a marine structure 2. On the fourth side, which adheres to the marine structure 2, the intermediate layer 4 encloses the corners, providing an extra protection, but does not necessarily enclose the core. The intermediate layer 4 is preferably a fiber reinforced cloth, to reinforce the strength and durability of the fender 1 and to improve the core's protection against impact, as the cloth can provide resistance against tearing. The fibre reinforced cloth may for example be a PVC-cloth or a neoprene cloth reinforced with known fibres such as canvas fibres, glass fibres or other known fibres. The cloth can for instance comprise Hypalon®. The cloth can for example be glued to the core to obtain a firm connection, for which typically a two-component adhesive can be used. The glueing of the cloth may form an airtight layer around the core, at least there where the core is covered by the intermediate layer, supporting the closed cell foam core during compression and reacting as a pneumatic fender.

The intermediate layer 4 can be covered by a coating 5, which can cover the entire intermediate layer 4, and which may also cover the core 3, where the core is not covered by the intermediate layer 4. Preferably, the coating 5 fully encloses the entire external surface of the fender 1, also the side of the fender 1 that will be attached to the marine structure 2. The coating can provide the fender with additional protection and resistance, for example against tearing, wear, or against UV radiation, and can provide the fender 1 with a water-tight layer. The coating 5 can for example be sprayed onto the intermediate layer 4, wherein the thickness of the coating can vary along the fender, adapting said thickness in zones of the fender which are more or less prone to wear. The thickness of the coating 5 may for example vary between 3-20 mm. The coating 5 can for example comprise PolyUrea™ or any other material with similar characteristics. In this embodiment, there is provided an intermediate layer 4 and a coating 5. Of course, many variants, with or without intermediate layer and/or with or without coating are possible.

In the fender 1 according to the invention, the core 3 comprises at least one chamber 6 substantially entirely surrounded by said closed cell foam 3 and enclosing an elastically deformable closed object 7. In the preferred embodiment represented in FIG. 1, said core comprises a plurality of said chambers 6, each chamber 6 comprising an elastically deformable closed object 7. The core 3 comprises at least two blocks of closed cell foam, in this case four blocks 3*a*, 3*b*, 3*c*, 3*d* of closed cell foam. Every chamber 6 extends into two adjacent blocks of closed cell foam. Compared to a prior art fender, the marine fender comprising a core 3 of closed cell foam with chambers 6 therein and elastically deformable objects 7 therein, can be lighter and/or smaller and/or more compact to obtain the same or similar energy absorbing capacity as the prior art fender. Should a vessel nevertheless require a relatively large area of the hull to be covered by the fender and/or a relatively large thickness of the fender, a layer of relatively high density foam may be provided additionally, which still may result in a lighter fender than using a prior art fender.

FIG. 2*a* shows a schematic side view of blocks of closed cell foam which are usable for manufacturing a fender according to a first aspect of the invention. FIG. 2*b* shows a schematic side view of the opened-up blocks of closed cell foam of FIG. 2*a* along the line A-A, and FIG. 2*c* shows a schematic perspective view on the blocks of closed cell foam of FIG. 2*b*. As closed cell foam is typically provided in solid premanufactured blocks, the blocks can be piled up to obtain a desired thickness of a fender. In case of substantially cuboid blocks, the sides with the largest surface area of two adjacent blocks can face each other to form two different layers. In FIGS. 2*a*, 2*b* and 2*c*, there are three layers 8*a*, 8*b*, 8*c* of such cuboid blocks of closed cell foam. Said different blocks and/or layers 8*a*, 8*b*, 8*c* of closed cell foam preferably have a mutually different density. As can be seen in FIGS. 2*b* and 2*c*, the core 3 comprises a plurality of chambers 6 substantially entirely surrounded by said closed cell foam 3. Each chamber 6 extends into two adjacent blocks 8*a*, 8*b* or 8*b*, 8*c* of closed cell foam. Each chamber 6 encloses an elastically deformable closed object 7. Said elastically deformable closed object 7 preferably tightly fits in said chamber 6. In the embodiment of FIGS. 2*b* and 2*c*, the elastically deformable closed object 7 is a substantially spherical object. FIGS. 3*a* and 3*b* show schematic perspective views on two alternative opened-up blocks of closed cell foam, where the elastically deformable objects 7 have a different shape, i.e. a cylindrical shape with spherical ends. In this alternative embodiment, a longitudinal axis of said elongated elastically deformable closed objects 7 can extend along three different axes, of which two examples are shown in FIGS. 3*a* and 3*b*. The position of these objects 7 can vary along the fender, and can for example be adapted to where the highest impact loads may be expected. The elastically deformable closed objects 7 can have other shapes, but in order to enhance their resiliency, it is preferred to avoid shapes comprising ribs and/or corners. In an advantageous embodiment, as represented in FIGS. 2*b* and 2*c*, said elastically deformable closed object may be a ball-like object comprising a substantially spherical closed shell, which shell can for example comprise rubber. Said shell may be typically filled with air, for example pressureless air, i.e. with a pressure equal to the surrounding air pressure, such that the ball-like object can produce a bouncing effect similar to a bouncing ball when experiencing a high impact load. A rubber-like shell comprising air inside can absorb relatively high impacts without tearing or breaking due to the high restoring capacities of such a ball-like object. This is contrary to other classical springs, for example metal spiral springs, which can easily break once an impact is higher than a given limit. Alternatively, said elastically deformable closed object 7 could also be filled with rubber, or with a closed cell foam having a different density than the density of the surrounding closed cell foam. The elastically deformable closed objects 7 could also be a hollow object different from a ball-like object, such as for example shown in FIGS. 3*a* and 3*b*.

FIG. 4 shows a schematic perspective view on a preferred step of a method for manufacturing a marine fender according to a second aspect of the invention. In order to advantageously prepare blocks of closed cell foam, as represented in FIGS. 2*a*, 2*b* and 2*c*, for the manufacturing of a fender 1 according to a first aspect of the invention, the invention also provides an very advantageous method for manufacturing such a fender 1. According to said method, at least one block of closed cell foam is provided, in which at least one hollow chamber is made, for example carved out. It is however preferred to provide at least two blocks of closed cell foam, or for example three blocks 8*a*, 8*b* and 8*c*. Then a first chamber part 6*a* can be provided, for example carved out, in a first block, for example in block 8*c*, more specifically on one of the two large and wide sides 9, 10 of the cuboid block 8*c*. Preferably, a plurality of first chamber parts 6*a* is carved out in said side 9, which parts 6*a* are for example halves of a sphere. Corresponding second chamber parts 6*b* can then be provided in a second block, for example in a side 10 of block 8*b*, such that said first chamber parts 6*a* and second chamber parts 6*b* can together form a chamber extending over two adjacent blocks of closed cell foam. In a same block 8*b*, two sides 9 and 10 can both be provided with first and second chamber parts 6*a*, 6*b*. In a next step, an elastically deformable closed object 7 is inserted into the chamber 6, preferably, into a first chamber part 6*a*, preferably one elastic deformable closed object 7 in each first chamber part 6*a*. Advantageously, the balls are glued in the chambers, by means of an adhesive material well known the skilled person, e.g. glue or any other suitable adhesive material. The balls can alternatively be connected mechanically to the chamber e.g. by hooks or bayonet-connection. Many variants are possible.

As is illustrated in FIG. 5, showing a schematic side view on a preferred step of a method for manufacturing a marine fender, the chambers 6 can then be closed by placing the other of the first or second chamber part, e.g. the second chamber parts 6*b*, in the first or second block, for example in block 8*b*, over the closed objects 7. The first and second chamber parts 6*a*, 6*b* are such that the closed objects 7 preferably tightly fit into the chamber 6 formed by said two chamber parts, and such that the closed cell foam of one block is in contact with the closed cell foam of an adjacent block in between said closed objects, as can be seen in FIG. 2*a*. Once the desired thickness for the fender 1 has been reached and the core structure 3 of the fender 1 is ready, an intermediate layer 4 can be provided, which at least partly encloses the at last one block of closed cell foam, for example as shown in FIG. 1. Then a coating 5 can be provided which at least partly, preferably fully, covers the intermediate layer 4. The coating 5 can also cover part of the core 3 which is not covered by an intermediate layer 4, as is for example the case in the embodiment of FIG. 1, where the side of the fender 1 that is attached to a marine structure 2 is not entirely covered by the intermediate layer 4, but is covered by the coating 5.

For the purpose of clarity and a concise description, features are described herein as part of the same or separate embodiments, however, it will be appreciated that the scope of the invention may include embodiments having combinations of all or some of the features described. It may be understood that the embodiments shown have the same or similar components, apart from where they are described as being different.

In the claims, any reference signs placed between parentheses shall not be construed as limiting the claim. The word 'comprising' does not exclude the presence of other features or steps than those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to an advantage. Many variants will be apparent to the person skilled in the art. All variants are understood to be comprised within the scope of the invention defined in the following claims.

The invention claimed is:

1. A marine fender for impact protection comprising:

a core of closed cell foam, wherein said core comprises at least one chamber substantially entirely surrounded by said closed cell foam; and an elastically deformable closed object enclosed in said at least one chamber, wherein the core of closed cell foam comprises at least first and second blocks of closed cell foam, wherein said first block is located adjacent to said second block, wherein said at least one chamber is formed in and extends between said first and second blocks of closed cell foam, wherein a first chamber part of the at least one chamber is provided in the first block and a second chamber part of said at least one chamber is provided in the second block, and wherein the first and second blocks are joined together so that the first and second chamber parts form the at least one chamber and enclose the elastically deformable closed object.

2. The marine fender according to claim 1, wherein the elastically deformable closed object tightly fits in said at least one chamber.

3. The marine fender according to claim 1, wherein said at least one chamber comprises a plurality of chambers, each chamber comprising an elastically deformable closed object.

4. The marine fender according to claim 1, wherein said first and second blocks of closed cell foam have a mutually different density.

5. The marine fender according to claim 1, wherein said elastically deformable closed object is a substantially spherical object.

6. The marine fender according to claim 1, wherein said elastically deformable closed object comprises rubber.

7. The marine fender according to claim 1, wherein said elastically deformable closed object is a hollow object.

8. The marine fender according to claim 1, wherein said elastically deformable closed object is a ball-like object comprising a substantially spherical closed shell.

9. The marine fender according to claim 8, wherein said elastically deformable closed object is a resilient ball.

10. The marine fender according to claim 1, further comprising an intermediate layer at least partly enclosing the core and a coating at least partly covering the intermediate layer.

11. A method for manufacturing a marine fender comprising:

providing at least first and second blocks of closed cell foam, wherein the first block is located adjacent to the second block;

providing in the first and second blocks of closed cell foam at least one hollow chamber entirely surrounded by said closed cell foam, wherein the at least one hollow chamber comprises a first chamber part in the first block and a second chamber part in the second block;

inserting a first end of an elastically deformable closed object into the first chamber part of the first block, and placing a second end of the elastically deformable closed object into the second chamber part in the second block to enclose the elastically deformable closed object and seal the chamber.

12. The method according to claim 11, wherein the at least one hollow chamber is carved out of the first and second blocks of closed cell foam.

13. The method according to claim 11, further comprising:

providing an intermediate layer at least partly enclosing the at least first and second blocks of closed cell foam; and providing a coating at least partly covering the intermediate layer.

* * * * *